US009692122B2

(12) United States Patent
Desclos et al.

(10) Patent No.: US 9,692,122 B2
(45) Date of Patent: Jun. 27, 2017

(54) MULTI LEVELED ACTIVE ANTENNA CONFIGURATION FOR MULTIBAND MIMO LTE SYSTEM

(71) Applicant: Ethertronics, Inc., San Diego, CA (US)

(72) Inventors: Laurent Desclos, San Diego, CA (US); Jeffrey Shamblin, San Marcos, CA (US); Sung-Su Nam, Seoul (KR); Sung Hawan, Gyeonggi-do (KR); Ji-Chul Lee, Gyeonggi-do (KR); Chun-Su Yoon, Gyeonggi-do (KR)

(73) Assignee: ETHERTRONICS, INC., San Diego, CA (US)

( * ) Notice: Subject to any disclaimer, the term of this patent is extended or adjusted under 35 U.S.C. 154(b) by 684 days.

(21) Appl. No.: 14/094,778

(22) Filed: Dec. 2, 2013

(65) Prior Publication Data

US 2015/0155624 A1 Jun. 4, 2015

Related U.S. Application Data

(63) Continuation of application No. 13/612,809, filed on Sep. 12, 2012, now abandoned, which is a (Continued)

(51) Int. Cl.
*H01Q 9/06* (2006.01)
*H01Q 3/22* (2006.01)
(Continued)

(52) U.S. Cl.
CPC ..... *H01Q 3/22* (2013.01); *H01Q 1/246* (2013.01); *H01Q 1/521* (2013.01); *H01Q 5/28* (2015.01); *H01Q 9/42* (2013.01); *H01Q 21/28* (2013.01)

(58) Field of Classification Search
CPC ..... H01Q 3/22; H01Q 1/246; H01Q 1/521; H01Q 21/28; H01Q 5/28; H01Q 9/42
(Continued)

(56) References Cited

U.S. PATENT DOCUMENTS 2,318,516 A 5/1943 Newbold
2,433,804 A 12/1947 Wolff
(Continued)

*Primary Examiner* — Tho G Phan
(74) *Attorney, Agent, or Firm* — Coastal Patent Law Group, P.C.

(57) ABSTRACT

An active antenna system and algorithm is described that provides for dynamic tuning and optimization of antenna system parameters for a MIMO system where correlation and isolation between antennas in the system are dynamically altered to provide for greater throughput. As one or multiple antennas are loaded or de-tuned due to environmental changes, corrections to correlation and/or isolation are made by selecting the optimal antenna radiation pattern and by adjusting electrical length and/or reactive loading of transmission lines connecting the antennas. Multiple Isolated Magnetic Dipole (IMD) antennas are co-located and connected with a feed network that can include switches that adjust phase length for transmission lines connecting the antennas. Filtering is integrated into the feed network to improve rejection of unwanted frequencies. Filtering can also be implemented on the antenna structure.

9 Claims, 11 Drawing Sheets

Related U.S. Application Data continuation-in-part of application No. 13/227,361, filed on Sep. 7, 2011, now abandoned, which is a continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402.

(60) Provisional application No. 61/533,559, filed on Sep. 12, 2011.

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 21/28*** | (2006.01) |
| ***H01Q 5/28*** | (2015.01) |

(58) Field of Classification Search

USPC ..... 343/700 MS, 745, 750, 813, 815, 833, 343/834, 853, 876

See application file for complete search history.

(56) References Cited

U.S. PATENT DOCUMENTS

| | | | | |
|---|---|---|---|---|
| 3,419,869 | A | 12/1968 | Altmayer | |
| 6,104,349 | A * | 8/2000 | Cohen | H01Q 1/246 343/702 |
| 6,384,792 | B2 | 5/2002 | Apostolos | |
| 7,265,720 | B1 * | 9/2007 | Ponce De Leon | H01Q 1/243 343/700 MS |
| 7,525,504 | B1 * | 4/2009 | Song | H01Q 1/246 343/700 MS |
| 7,616,163 | B2 * | 11/2009 | Montgomery | H01Q 1/2258 343/722 |
| 7,834,813 | B2 * | 11/2010 | Caimi | H01Q 9/045 343/745 |
| 7,999,746 | B2 * | 8/2011 | Cho | H01Q 1/243 343/700 MS |
| 2004/0207559 | A1 * | 10/2004 | Milosavljevic | H01Q 1/243 343/702 |

* cited by examiner

47

| Free Space Parameters | | | | | | |
|---|---|---|---|---|---|---|
| | Correlation | Isolation | TRP | TIS | Sensor 1 | Sensor N |
| Modal Antenna 1 | ... | ... | ... | ... | ... | ... |
| Modal Antenna 2 | ... | ... | ... | ... | ... | ... |
| ... | ... | ... | ... | ... | ... | ... |
| Modal Antenna M | ... | ... | ... | ... | ... | ... |
| Active Filter Block 1 | ... | ... | ... | ... | ... | ... |
| Active Filter Block 2 | ... | ... | ... | ... | ... | ... |
| ... | ... | ... | ... | ... | ... | ... |
| Active Filter Block M | ... | ... | ... | ... | ... | ... |

| Hand and Head Parameters | | | | | | |
|---|---|---|---|---|---|---|
| | Correlation | Isolation | TRP | TIS | Sensor 1 | Sensor N |
| Modal Antenna 1 | ... | ... | ... | ... | ... | ... |
| Modal Antenna 2 | ... | ... | ... | ... | ... | ... |
| ... | ... | ... | ... | ... | ... | ... |
| Modal Antenna M | ... | ... | ... | ... | ... | ... |
| Active Filter Block 1 | ... | ... | ... | ... | ... | ... |
| Active Filter Block 2 | ... | ... | ... | ... | ... | ... |
| ... | ... | ... | ... | ... | ... | ... |
| Active Filter Block M | ... | ... | ... | ... | ... | ... |

| Head Parameters | | | | | | |
|---|---|---|---|---|---|---|
| | Correlation | Isolation | TRP | TIS | Sensor 1 | Sensor N |
| Modal Antenna 1 | ... | ... | ... | ... | ... | ... |
| Modal Antenna 2 | ... | ... | ... | ... | ... | ... |
| ... | ... | ... | ... | ... | ... | ... |
| Modal Antenna M | ... | ... | ... | ... | ... | ... |
| Active Filter Block 1 | ... | ... | ... | ... | ... | ... |
| Active Filter Block 2 | ... | ... | ... | ... | ... | ... |
| ... | ... | ... | ... | ... | ... | ... |
| Active Filter Block M | ... | ... | ... | ... | ... | ... |

FIG.5

Correlation matrix for 6 antenna MIMO system using Modal antennas with 2 Modes

| Antenna | Modes | |
|---|---|---|
| A1 | A1,1 | A1,2 |
| A2 | A2,1 | A2,2 |
| A3 | A3,1 | A3,2 |
| A4 | A4,1 | A4,2 |
| A5 | A5,1 | A5,2 |
| A6 | A6,1 | A6,2 |

← 6 Modal antennas with 2 radiating Mode

| Antenna | Correlation | | | | |
|---|---|---|---|---|---|
| A1 | C1,1,2 | C1,1,3 | C1,1,4 | C1,1,5 | C1,1,6 |
| A2 | | C2,1,3 | C2,1,4 | C2,1,5 | C2,1,6 |
| A3 | | | C3,1,4 | C3,1,5 | C3,1,6 |
| A4 | | | | C4,1,5 | C4,1,6 |
| A5 | | | | | C5,1,6 |

| Antenna | Correlation | | |
|---|---|---|---|
| | 4 | C1,2,5 | C1,2,6 |
| | | C2,2,5 | C2,2,6 |
| | | C3,2,5 | C3,2,6 |
| | | C4,2,5 | C4,2,6 |
| | | | C5,2,6 |

MULTI LEVELED ACTIVE ANTENNA CONFIGURATION FOR MULTIBAND MIMO LTE SYSTEM

CROSS-REFERENCE TO RELATED APPLICATIONS

This application is a continuation of U.S. patent application Ser. No. 13/612,809, filed Sep. 12, 2012, titled "MULTI LEVELED ACTIVE ANTENNA CONFIGURATION FOR MULTIBAND MIMO LTE SYSTEM";

which is:

a continuation in part (CIP) of U.S. patent application Ser. No. 13/029,564, filed Feb. 17, 2011, titled "ANTENNA AND METHOD FOR STEERING ANTENNA BEAM DIRECTION", which is a continuation of U.S. patent application Ser. No. 12/043,090, filed Mar. 5, 2008, also titled "ANTENNA AND METHOD FOR STEERING ANTENNA BEAM DIRECTION";

a continuation in part (CIP) of U.S. patent application Ser. No. 13/227,361, filed Sep. 7, 2011, titled "MODAL ANTENNA WITH CORRELATION MANAGEMENT FOR DIVERSITY APPLICATIONS"; and claims benefit of priority to U.S. Provisional Application Ser. No. 61/533,559, filed Sep. 12, 2011, titled "MULTI LEVELED ACTIVE ANTENNA CONFIGURATION FOR MULTIBAND MIMO LTE SYSTEM";

the contents of each of which are hereby incorporated by reference.

BACKGROUND OF THE INVENTION

Field of the Invention

This invention relates generally to the field of wireless communications; and more particularly, to Multiple Input Multiple Output (MIMO) antenna implementations capable of robust multi-band operation for use in wireless communications.

Related Art

Current and future communication systems will require improved MIMO antenna systems capable of operation over multiple frequency bands. Isolation between adjacent elements as well as de-correlated radiation patterns will need to be maintained across multiple frequency bands, with antenna efficiency needing to be optimized for the antenna system.

Commonly owned U.S. Pat. No. 7,911,402, issued Mar. 22, 2011, describes a beam steering technique wherein a single antenna is capable of generating multiple radiating modes; the contents of which are hereby incorporated by reference. This is effectuated with the use of offset parasitic elements that alter the current distribution on the driven antenna as the reactive load on the parasitic is varied. This beam steering technique where multiple modes are generated is referred to as a "modal antenna technique", and an antenna configured to alter radiating modes in this fashion will be referred to herein as an "active modal antenna".

Commonly owned U.S. application Ser. No. 13/227,361, filed Sep. 7, 2011, describes a receive diversity antenna utilizing an active modal antenna as described in the '402 patent, wherein a single modal antenna can be configured to generate multiple radiating modes to provide a form of switched diversity; the contents of which are hereby incorporated by reference. The benefits of this technique include reduced volume in the mobile device for a single antenna instead of a two antenna receive diversity scheme, reduction in receive ports on the transceiver from two to one, and the resultant reduction in current consumption from this reduction in receive ports.

With MIMO (Multiple Input Multiple Output) systems becoming more prevalent in the access point and cellular communication fields, the need for two or more antennas collocated in a mobile device or small form factor access point are becoming more common. These groups of antennas in a MIMO system need to have high, and preferably, equal efficiencies along with good isolation and low correlation. For handheld mobile devices the problem is exacerbated by antenna detuning caused by the multiple use cases of a device: hand loading of the cell phone, cell phone placed to user's head, cell phone placed on metal surface, etc. For both cell phone and access point applications, the multipath environment is constantly changing, which impacts throughput performance of the communication link.

SUMMARY OF THE INVENTION

Antennas and methods are disclosed relating to the design of a multi-band antenna system that provides for dynamic adjustment of correlation and isolation between multiple antennas at a multitude of frequency bands. A transmission line network is described that optimizes isolation between antennas that incorporates filters, switches, and/or passive and active components to provide a fixed or dynamically tuned multi-antenna system. A beam steering feature is described capable of changing the radiation pattern of one or multiple antennas.

BRIEF DESCRIPTION OF THE DRAWINGS

FIG. 5 illustrates an example database and various data that may be utilized in the various embodiments herein.

DETAILED DESCRIPTION OF THE PREFERRED EMBODIMENTS

Figure 1A:
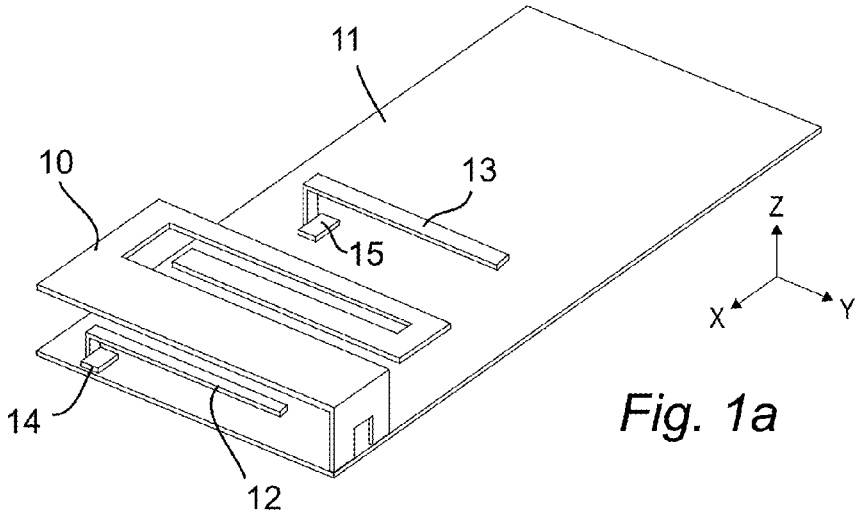
FIGS. 1(A-C) illustrate an active modal antenna capable of band switching and beam steering functions.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

Now turning to the drawings, FIG. 1 illustrates various concepts behind the theory and operation of a modal antenna disclosed in commonly owned U.S. Pat. No. 7,911,402, issued Mar. 22, 2011; the contents of which are hereby incorporated by reference. Two radiation modes can be generated by providing an open circuit at the junction of an offset parasitic and the ground plane, or a short circuit condition. A second parasitic is placed beneath the IMD (Isolated Magnetic Dipole) antenna and is used to compensate for a frequency shift experienced when the offset parasitic is switched from the open to short circuit condition.

Figure 1B:
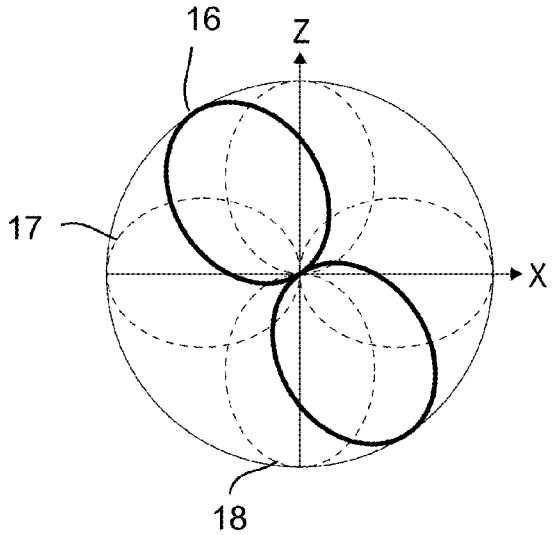
Figure 1C:
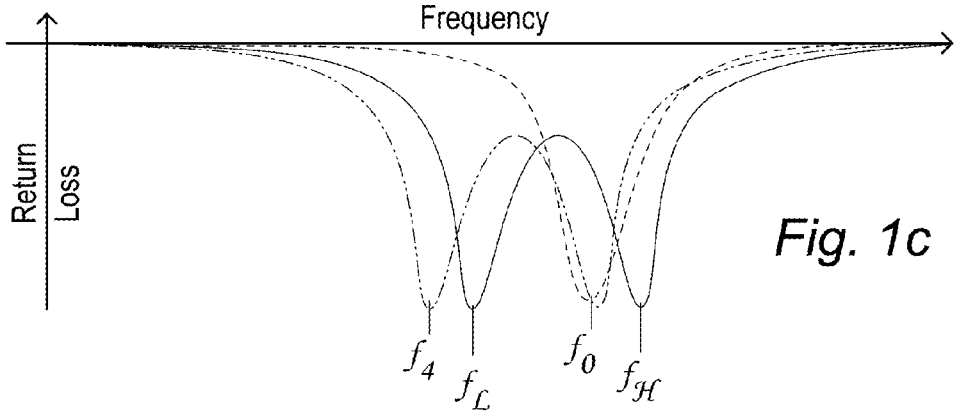

FIGS. 1(*a-c*) illustrate an example of an active modal antenna in accordance with the '402 patent, wherein FIG. 1 a depicts a circuit board 11 and a driven antenna element 10 disposed thereon, a volume between the circuit board and the driven antenna element forms an antenna volume. A first parasitic element 12 is positioned at least partially within the antenna volume, and further comprises a first active tuning element 14 coupled therewith. The first active tuning element 14 can be a passive or active component or series of components, and is adapted to alter a reactance on the first parasitic element either by way of a variable reactance, or shorting to ground, resulting in a frequency shift of the antenna. A second parasitic element 13 is disposed about the circuit board and positioned outside of the antenna volume. The second parasitic element 13 further comprises a second active tuning element 15 which individually comprises one or more active and passive components. The second parasitic element is positioned adjacent to the driven element and yet outside of the antenna volume, resulting in an ability to steer the radiation pattern of the driven antenna element by varying a current flow thereon. This shifting of the antenna radiation pattern is a type of "antenna beam steering". In instances where the antenna radiation pattern comprises a null, a similar operation can be referred to as "null steering" since the null can be steered to an alternative position about the antenna. In the illustrated example, the second active tuning element comprises a switch for shorting the second parasitic to ground when "On" and for terminating the short when "Off". It should however be noted that a variable reactance on either of the first or second parasitic elements, for example by using a variable capacitor or other tunable component, may further provide a variable shifting of the antenna pattern or the frequency response. FIG. 1*c* illustrates the frequency (f0) of the antenna when the first and second parasitic are switched "Off"; the split frequency response (fL;fH) of the antenna when the second parasitic is shorted to ground; and the frequencies (f4; f0) when the first and second parasitic elements are each shorted to ground. FIG. 1*b* depicts the antenna radiation pattern in a first mode 16 when both the first and second parasitic elements are "Off"; in a second mode 17 when only the second parasitic is shorted to ground; and a third mode 18 when both the first and second parasitic elements are shorted "On". Further details of this active modal antenna can be understood upon a review of the '402 patent; however generally one or more parasitic elements can be positioned about the driven element to provide band switching (frequency shifting) and/or beam steering of the antenna radiation pattern which is actively controlled using active tuning elements.

Figure 2:
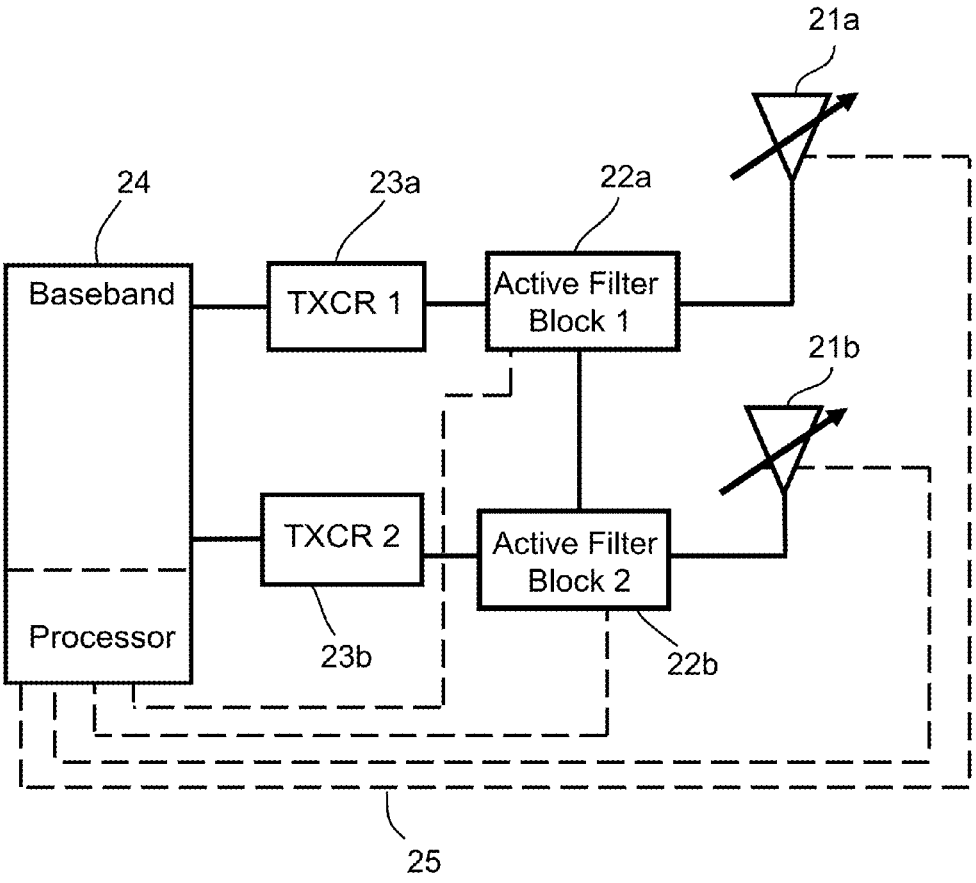
FIG. 2 illustrates a two antenna system comprising two active modal antennas and associated active filter blocks that are adapted for dynamic alteration of correlation and isolation.

FIG. 2 illustrates a two antenna configuration where modal antennas along with active filter blocks are used to provide the ability to dynamically alter correlation and isolation for the MIMO antenna system. An algorithm is resident in the processor, with the processor providing control signals for the active components to drive the modal antennas and active filter blocks.

The processor may include the baseband processor, or an applications processor or other processor in the wireless communications device. In certain preferred embodiments, a memory is provided for storing database records related to antenna modes. In this regard, the database records can comprise information stored by the device or downloaded from a network, the information can be used to configure the active filter blocks and active modal antennas for improving correlation and isolation.

In the example in FIG. 2, a baseband processor 24 is coupled to a first active modal antenna 21 a and associated first active filter block 22*a* and a second active modal antenna 21*b* and associated second active filter block 22*b* through control transmission lines 25, through which control signals may be communicated from the processor 24 for actively configuring the filter blocks 22*a*, 22*b* and modal antennas 21*a*, 21*b*, respectively. The baseband processor 24 is further connected to a first transceiver 23*a* and a second transceiver 23*b*, which are in turn connected to the first and second active filter blocks 22*a*, 22*b* and modal antennas 21*a*, 21*b*, respectively. In this example, the antenna system is adapted to generate control signals in the processor and communicate the control signals to the active filter blocks and modal antennas for varying parameters and dynamically controlling antenna modes for enhanced performance.

Figure 3:
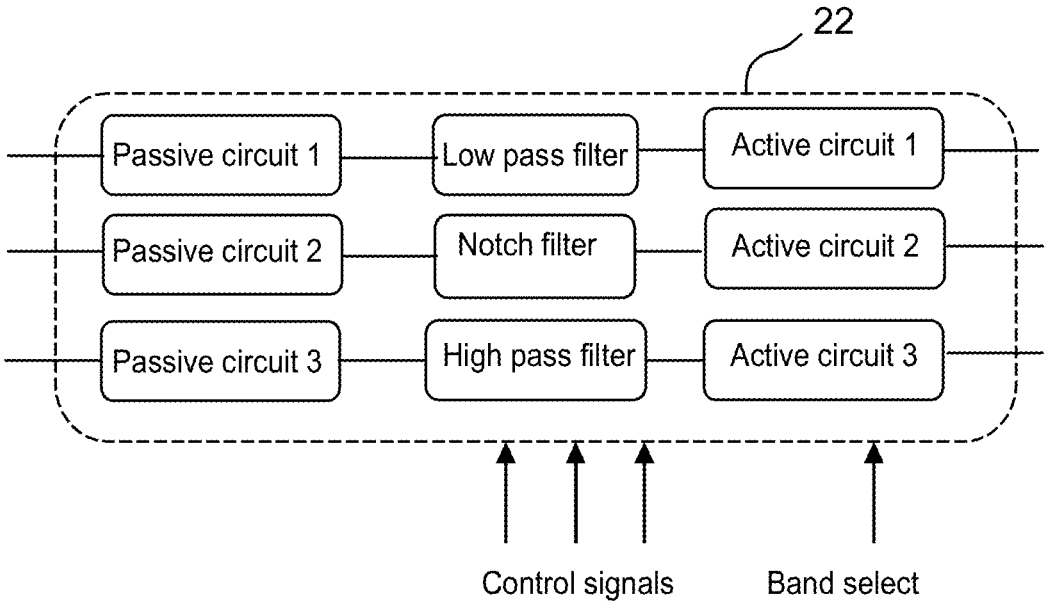
FIG. 3 illustrates an example topology for an active filter block.

FIG. 3 illustrates a topology for the active filter blocks 22. A combination of both passive and active circuits along with a filter can be configured in parallel paths to provide a high degree of flexibility in altering the reactance and/or electrical length over a wide frequency range. Though this example may be used in various embodiments, the topology of the active filter blocks may vary and can be designed with numerous variations by those having skill in the art, thus the scope of the illustrated embodiment of FIG. 3 is not intended to be limiting in scope.

Figure 4:
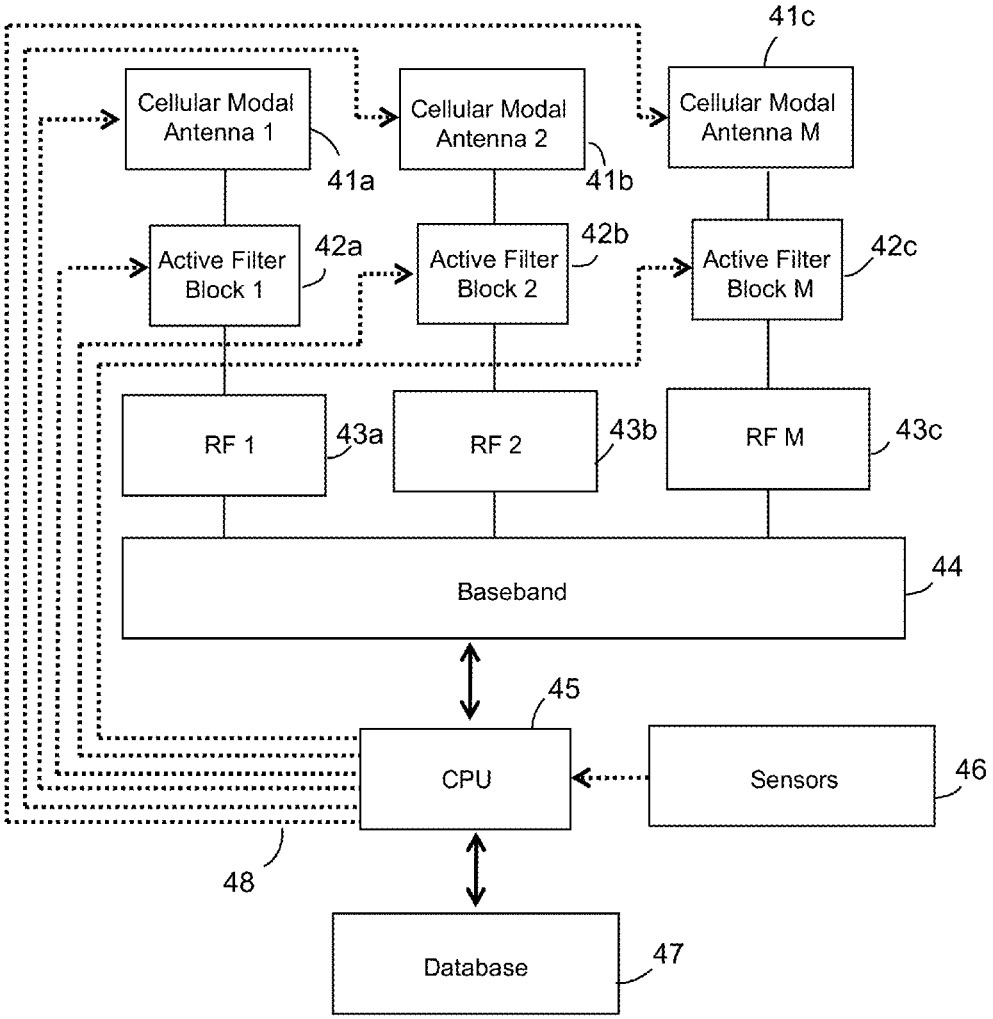
FIG. 4 illustrates a schematic of multiple active modal antennas for use in MIMO applications comprising a plurality of active modal antennas and active filter blocks controlled by control signals generated by a processor.

FIG. 4 illustrates a block diagram of a multi-antenna system for MIMO applications utilizing modal antennas and active filter blocks. Sensors provide inputs to a CPU, with the CPU accessing a data base in memory of previously stored use cases to assist in selecting optimal tuning parameters.

In the example of FIG. 4, one or more sensors 46, such as capacitive sensors or other sensors are coupled to a CPU 45 and adapted to determine a use case of a wireless device. Example use cases may include free space positioning, hand coupling, head and hand coupling, etc. The CPU is capable of accessing a memory where a database 47 of records is stored. The database 47 can be programmed with information relating to various use cases of the device and stored information parameters for configuring one or more active filter blocks 42*a-c* and modal antennas 41*a-c* to achieve optimization. In this regard, the CPU is coupled to the active filter blocks and modal antennas via control transmission lines 48. The CPU is further adapted to analyze signal through baseband from one or more modal antennas coupled to independent filter blocks. In this regard, the antenna system comprises a plurality of active modal antennas and active filter blocks being adapted for control by a processor capable of accessing information in a database.

FIG. 5 illustrates typical data found in memory that can be accessed to better determine tuning parameters. Antenna system metrics such as correlation, isolation, TRP (total radiated power) and TIS (total isotropic sensitivity) are stored for various use cases such as free space conditions, against the head, and head and hand loading. Sensor inputs for these conditions are resident in the database 47.

Figure 6:
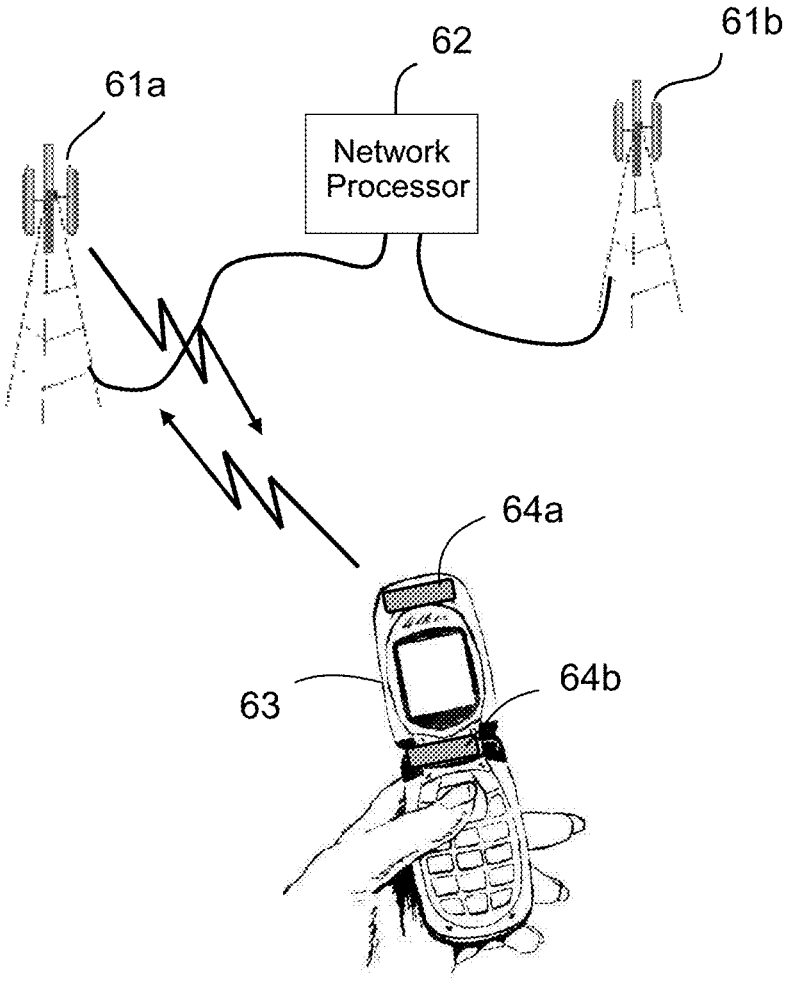
FIG. 6 illustrates a mobile phone having an antenna system connected to a network, the database can be programmed by an OEM, stored on a network, or downloaded and programmed into the mobile phone.

FIG. 6 illustrates options for storage of the data base used to assist in optimizing antenna system performance. The data base can reside in the mobile device or can be resident on the network CPU. The data base can be installed in the mobile device in the factory during manufacture or in the field during use and operation.

In FIG. 6, a mobile wireless communications device is connected to a wireless network through a first base station 61 a. The device 63 comprises a first modal antenna 64*a* and a second modal antenna 64*b* in accordance with embodiments herein. The first base station 61 a is further connected to a network processor 62 or server, which in turn is coupled to one or more additional base stations 61*b*. The device 63 can be pre-programmed with database records for configuring the first and second modal antennas 64*a*, 64*b*. Alternatively, the device can be adapted to download database records from the network server. Still further, the device can be adapted to access database records stored on the network processor for downloading and utilizing with internal active modal antennas and active filter blocks. It should be noted that in certain embodiments where antenna performance, such as signal, isolation, and correlation, is sampled, the device may be configured to store improved parameters for future lookup.

Figure 7:
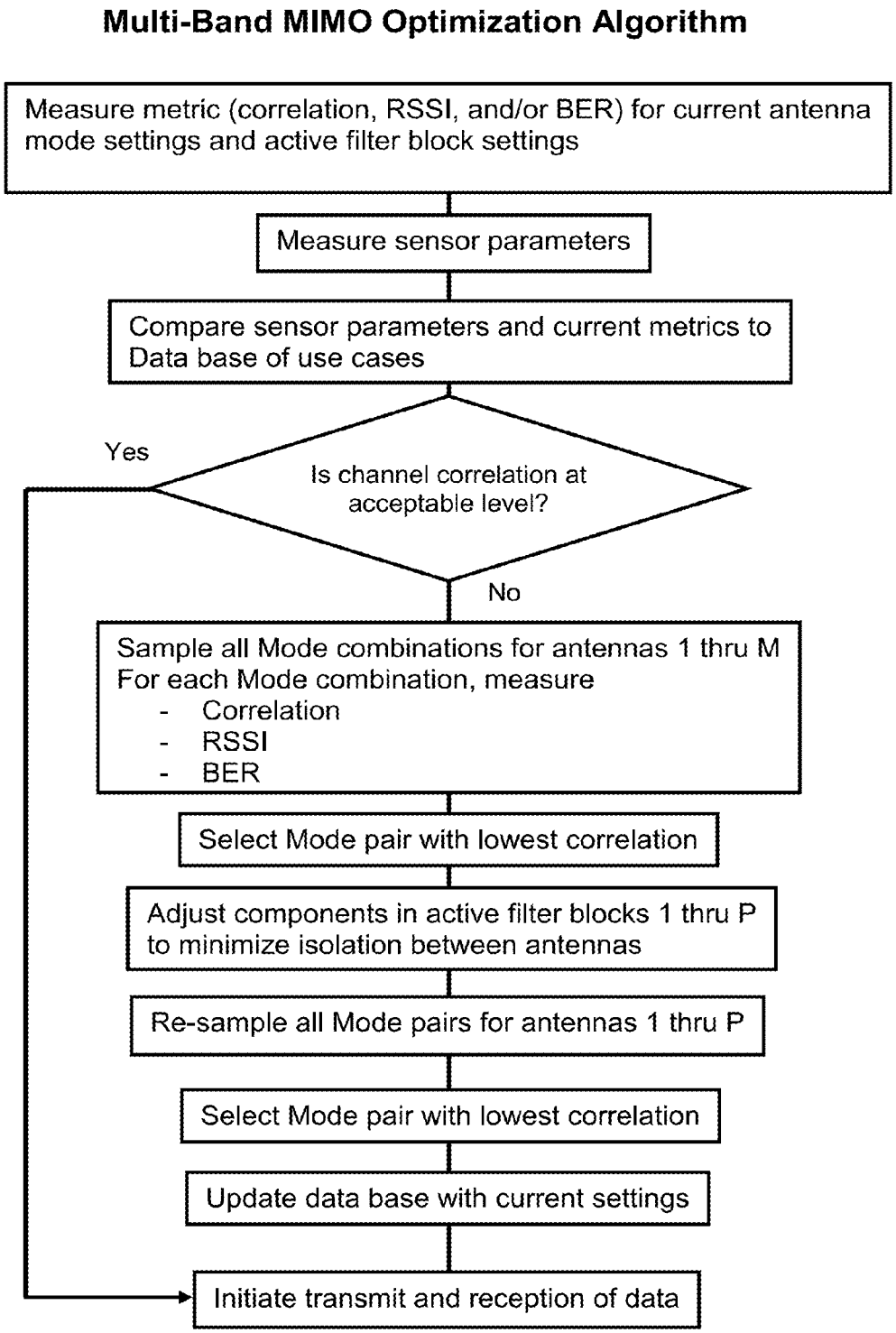
FIG. 7 illustrates a sample algorithm for optimization of a MIMO antenna system in accordance with various embodiments.

FIG. 7 illustrates an algorithm for optimization of a MIMO antenna system over multiple frequency bands. One or multiple metrics such as correlation, RSSI (Receive System Sensitivity Indicator), or BER (Bit Error Rate) are monitored along with sensor inputs. A decision is made as to whether the channel correlation s acceptable; if not an optimization routine is implemented where the multiple radiation modes of each modal antenna is sampled to determine the mode pairing that minimizes correlation. The active antenna blocks are then altered to reduce isolation between antennas for the selected mode pairing.

Figure 8A:
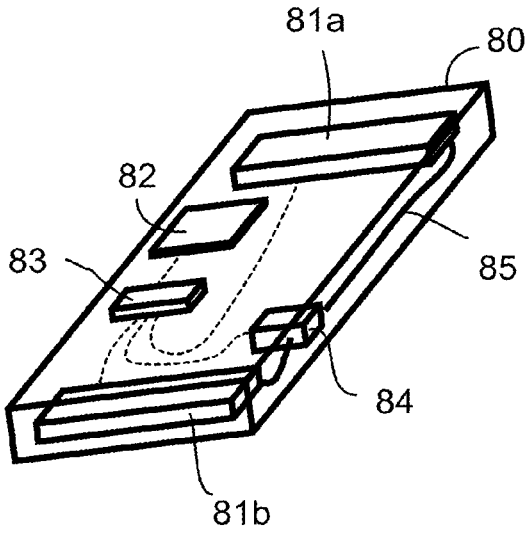
FIGS. 8(A-B) illustrate a modal antenna configuration in a mobile device.
Figure 8B:
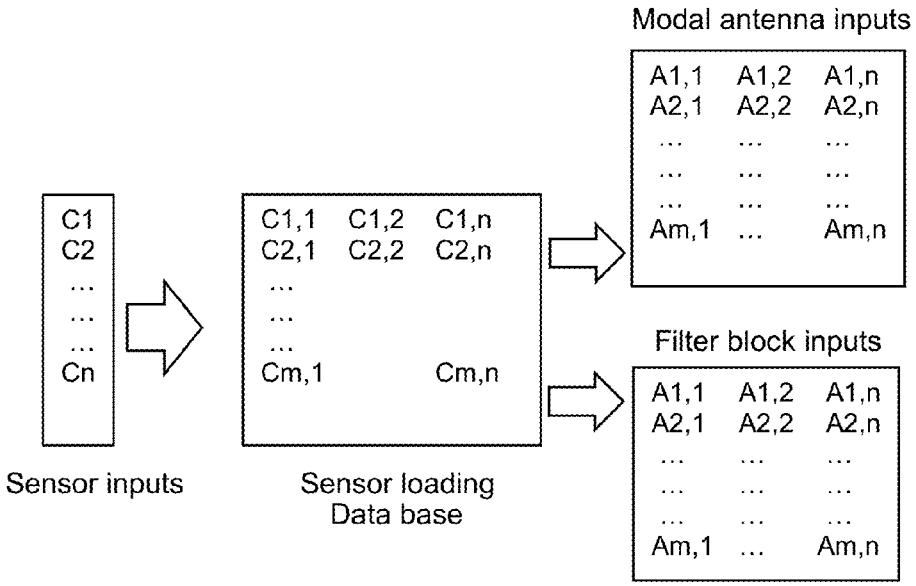

FIG. 8*a* illustrates a modal antenna configuration in a mobile device. Two modal antennas 81*a*, 81*b* along with a sensor 82, CPU 83 and active filter block 84 are shown along with respective transmission lines 85. FIG. 8*b* illustrates that the sensor inputs are used to form a comparison with sensor loading stored in the database to determine the type of loading condition that the mobile device is currently under. Inputs for both the modal antennas and active filter blocks are generated based on an estimate of the loading conditions.

Figure 9:
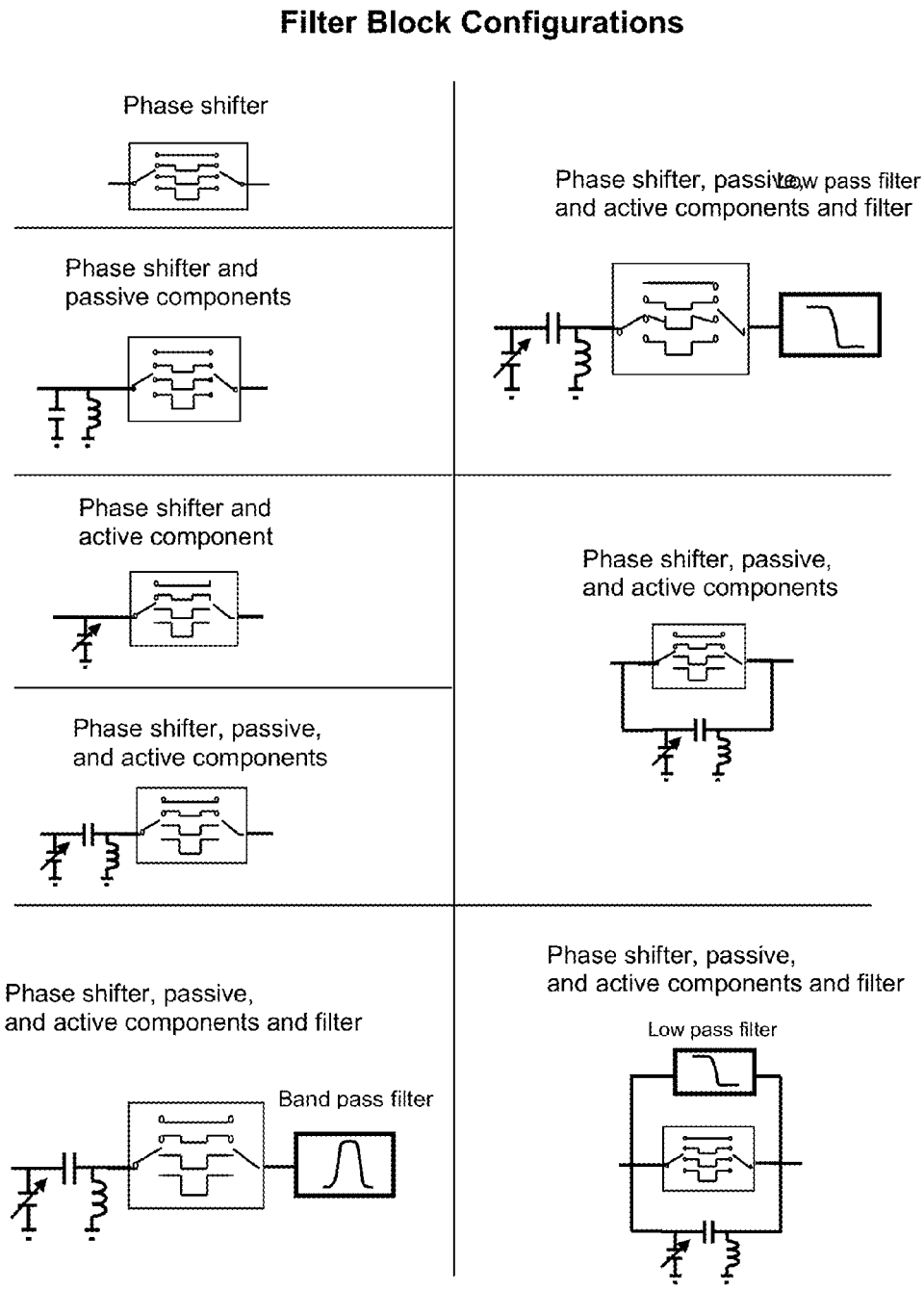
FIG. 9 illustrates various topologies for active filter blocks in accordance with the embodiments herein.

FIG. 9 illustrates various topologies for the active filter blocks. Series and parallel configurations where passive and active circuits along with switch-based phase shifters and filters are integrated are shown.

Figure 10A:
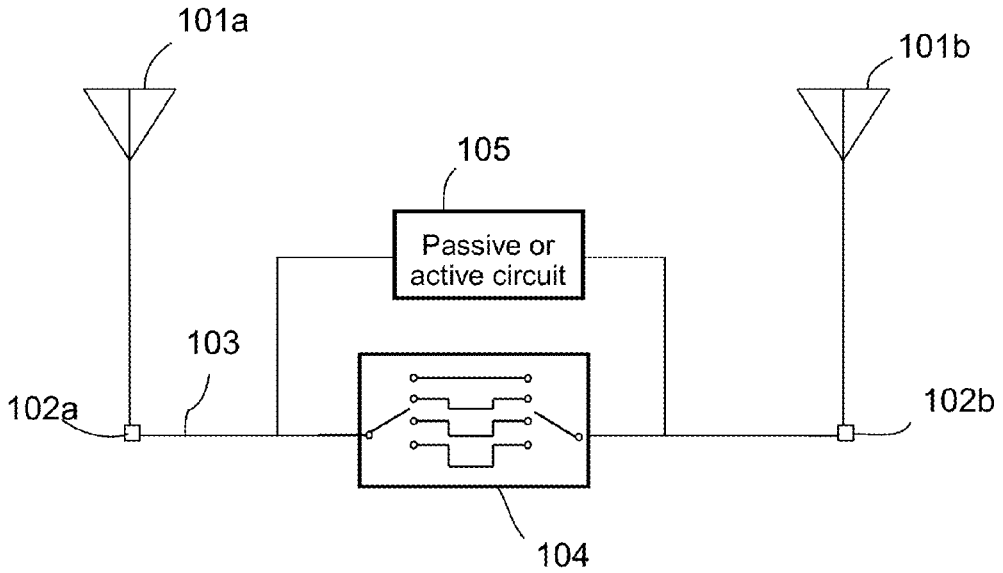
FIGS. 10(A-B) illustrate an antenna system having a switch-based phase shifter and passive or active circuits adapted to adjust a coupled signal between the antennas.
Figure 10B:
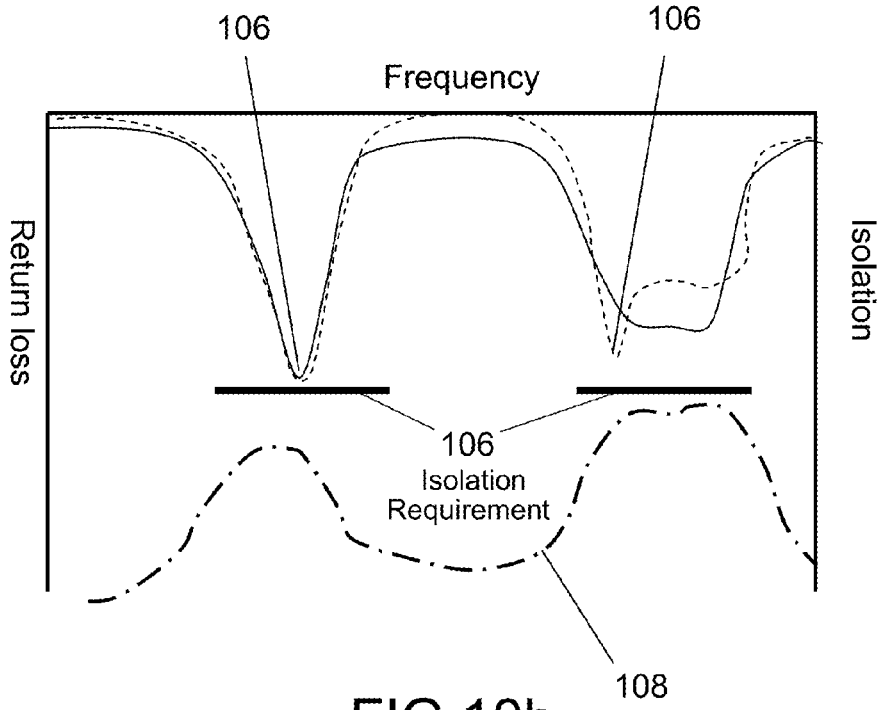

FIG. 10*a* illustrates an antenna configuration where a switch-based phase shifter 104 and passive or active circuit 105 are used to adjust a coupled signal between two antennas 101*a*, 101*b*. One or more switches or other components 102*a*, 102*b* can be coupled to each antenna through respective transmission lines 103. The coupled signal can be used to reduce the natural coupling between the antennas. The switched phase shifter and active components can be used to alter the coupling over a wide frequency range. FIG. 10*b* illustrates a plot representing frequency vs. isolation and return loss, and additionally illustrates an isolation requirement for the antenna of FIG. 10*a*.

Figure 11:
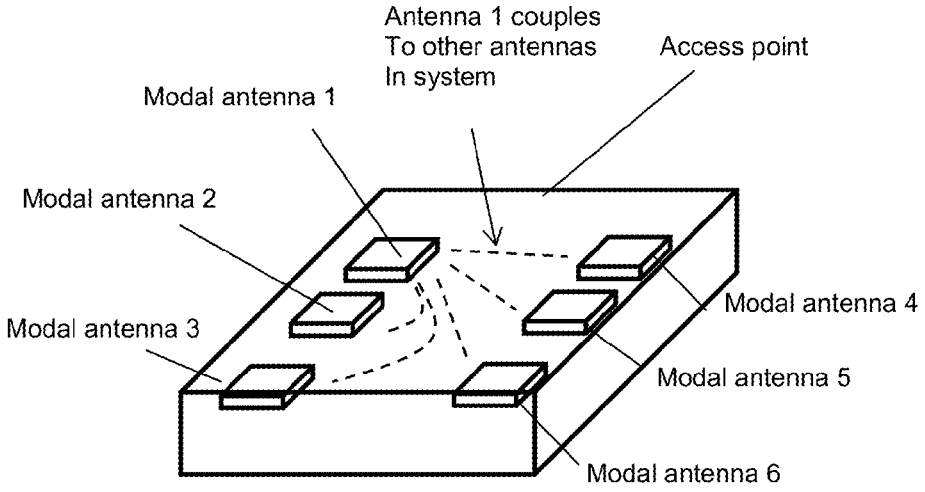
FIG. 11 illustrates a six-antenna MIMO antenna system integrated into a wireless access point.

FIG. 11 illustrates a six (6) antenna MIMO system integrated into the wireless access point. The antennas are Modal antennas, where each Modal antenna is capable of generating multiple radiation patterns or Modes. In this example, each Modal antenna is capable of generating two Modes, labeled 1 and 2. A correlation matrix is shown for the six (6) Modal antenna system, with the correlation between antennas being characterized by a thirty value (30) matrix.

In one embodiment, an antenna system comprises: a first modal device antenna adapted for operation at a plurality of antenna modes, each of the antenna modes of the first modal antenna having a distinct antenna radiation pattern; a second modal device antenna adapted for operation at a plurality of antenna modes, each of the antenna modes of the second modal antenna having a distinct antenna radiation pattern; a conductor coupling the first modal antenna to the second modal antenna; and a processor coupled to the first and second modal antennas and configured to select the mode from the plurality of modes associated with the modal antennas such that the correlation of the two antenna system is altered for optimal performance.

The antenna further comprises one or multiple tuning blocks, each active tuning block comprising one or multiple filters, one or multiple switches, one or multiple tunable components, and/or one or multiple passive components that alter the electrical length of a conductor connecting the two modal antennas. A processor coupled to the one or multiple tuning blocks provides control signaling to the tuning block to alter the characteristics of the conductor connecting the modal antennas.

In certain embodiments, pre-measured data is stored in memory and accessed to determine optimal modes for one or multiple modal antennas. The pre-measured data is accessed to determine optimal characteristics for the active components in the active tuning block or blocks.

Information from sensors may be used to determine optimal modes for one or multiple modal antennas. The sensor information is used to determine optimal characteristics for the active components in the active tuning block or blocks.

An algorithm is provided to receive and analyze sensor loading data, and send control signals to one or multiple modal antennas. The algorithm processes signals from individual sensors to estimate a loading profile of the wireless device; a data base of previously measured or calculated loading values is accessed to make an estimation of the loading on the device or the local environment. Antenna control signals are generated and sent to one or multiple modal antennas. The antenna control signals adjust tunable components in the modal antenna to optimize the antenna for the loading environment. Control signals are generated and sent to one or multiple active filter blocks. The control signals adjust tunable components in the active control block to optimize the antenna for the loading environment.

In certain embodiments, an active antenna system and algorithm is described that provides for dynamic tuning and optimization of antenna system parameters for a MIMO system where correlation and isolation between antennas in the system are dynamically altered to provide for greater throughput. As one or multiple antennas are loaded or de-tuned due to environmental changes, corrections to correlation and/or isolation are made by selecting the optimal antenna radiation pattern and by adjusting electrical length and/or reactive loading of transmission lines connecting the antennas. Multiple Isolated Magnetic Dipole (IMD) antennas are co-located and connected with a feed network that can include switches that adjust phase length for transmission lines connecting the antennas. Filtering is integrated into the feed network to improve rejection of unwanted frequencies. Filtering can also be implemented on the antenna structure.

In certain embodiments, one or more antenna elements may comprise a passive antenna structure. The antenna structure can comprise an isolated magnetic dipole (IMD), planar inverted F-type antenna (PIFA), inverted F-type antenna (IFA), monopole, dipole, loop, coil, or other antenna structure.

In certain other embodiments, three or more modal antennas are used in the system. In other embodiments, one or more passive antennas can be utilized.

The tunable components may comprise a switch, FET, MEMS device, or a component that exhibits active capacitive or inductive characteristics, or any combination of these components.

Other features and variations can be achieved by those having skill in the art without departing from the spirit and scope of the invention.

The invention claimed is:

1. An antenna system, comprising:

a first active modal antenna adapted for operation at a plurality of first antenna modes, each of said first antenna modes having a distinct antenna radiation pattern;

a second active modal antenna adapted for operation at a plurality of first second antenna modes, each of said second antenna modes having a distinct antenna radiation pattern;

a processor coupled to the first and second modal antennas and configured to vary antenna modes thereof;

at least one conductor coupling the first modal antenna with the second modal antenna in a multi-input multi-output (MIMO) configuration; and one or more active tuning blocks coupled to at least one of said first and second modal antennas, said active tuning blocks individually comprising one or more switches, filters, tunable components or passive components for altering a length of the conductor connecting the first and second modal antennas; and said processor further coupled to the one or more active tuning blocks and adapted to generate control signals for communicating therewith for configuring the active tuning blocks; and at least one of said first and second active modal antennas comprising:

a driven antenna element positioned above a circuit board forming an antenna volume therebetween, a first parasitic element positioned within the antenna volume and coupled to a first active element, the first parasitic element and first active element being configured to induce a shift in a frequency response of the driven antenna element, and a second parasitic element positioned outside of the antenna volume and adjacent to the driven element and coupled to a second active element, the second parasitic element and second active element being configured for steering the radiation pattern of the driven antenna element.

2. The antenna system of claim 1, comprising memory containing a database of records wherein information for configuring said first and second modal antennas and said one or more active tuning blocks is stored in said database.

3. The antenna system of claim 2, comprising sensors adapted to determine a use case of the antennas, wherein said sensors communicate the use case to said processor, and wherein said database is accessed to determine optimized parameters for configuring the antenna system.

4. The antenna system of claim 3, comprising an algorithm stored in said memory, said algorithm programmed to analyze loading data from said sensors and generate control signals for communicating with the modal antennas.

5. The antenna system of claim 4, said algorithm adapted to process signals from said sensors and estimate a loading profile of the wireless device; said antenna system further adapted to lookup said database records and estimate the loading of the device; and said processor adapted to generate control signals for adjusting tunable components in the active modal antennas and the active filter blocks for optimizing the antennas.

6. The antenna system of claim 1, further comprising a passive antenna.

7. The antenna system of claim 1, comprising three or more modal antennas.

8. The antenna system of claim 1, wherein each of said active modal antennas comprises one or more tunable components.

9. The antenna system of claim 8, wherein said tunable components are individually selected from the group consisting of: a switch, FET, MEMs device, tunable inductor, and a tunable capacitor.

* * * * *